United States Patent [19]

Kuchenbecker

[11] Patent Number: 4,613,046

[45] Date of Patent: Sep. 23, 1986

[54] RECLOSABLE PACKAGE AND CARTON BLANK

[75] Inventor: Morris W. Kuchenbecker, Neenah, Wis.

[73] Assignee: James River Corporation, Richmond, Va.

[21] Appl. No.: 625,725

[22] Filed: Jun. 28, 1984

[51] Int. Cl.[4] ..... B65D 5/54

[52] U.S. Cl. ..... 206/622; 206/607; 206/626; 206/630; 206/612; 229/17 R; 229/48 T

[58] Field of Search ..... 206/622, 624, 625, 626, 206/629, 630, 631, 634, 607, 621, 608, 628, 633; 229/37 R, 38, 17 R, 48 T

[56] References Cited

U.S. PATENT DOCUMENTS

| | | | |
|---|---|---|---|
| 1,606,439 | 11/1926 | Metzger | 229/17 R |
| 1,940,849 | 12/1933 | Davidson | 206/628 X |
| 1,987,647 | 1/1935 | Wellman | 229/37 R |
| 1,992,195 | 2/1935 | Daller | 229/37 R |
| 2,003,925 | 6/1935 | Daller | 229/17 R |
| 2,124,868 | 7/1938 | Davidson | 229/37 R |
| 2,412,031 | 12/1946 | Bergstein | 229/37 R |
| 2,521,208 | 9/1950 | Eaton | 229/37 R |
| 2,953,293 | 9/1960 | Anderson | 206/634 X |
| 2,973,086 | 2/1961 | Thompson | 206/633 X |
| 3,194,473 | 7/1965 | Rumberger | 229/37 R |
| 3,286,906 | 11/1966 | Rumberger | 229/37 R |
| 3,319,868 | 5/1967 | Huang et al. | 206/631 X |
| 3,426,955 | 2/1969 | Olson | 229/17 R |
| 3,438,565 | 4/1969 | Lugt et al. | 206/626 X |
| 3,438,566 | 4/1969 | Mahon | 206/626 |
| 3,526,353 | 9/1970 | Jaeschke | 206/607 |
| 3,971,506 | 7/1976 | Roenna | 206/626 |
| 4,043,503 | 8/1977 | Meyers et al. | 206/633 X |
| 4,083,486 | 4/1978 | Bergstein | 229/37 R |
| 4,530,461 | 7/1985 | Adamek | 229/37 R |

*Primary Examiner*—William Price
*Assistant Examiner*—Bryon Gehman
*Attorney, Agent, or Firm*—Gordon W. Hueschen

[57] ABSTRACT

The invention relates to a method and a carton blank for forming a reclosable package made of carton stock, coated at least on the end closure flaps thereof, with a heat-sealing coating, which comprises: a front panel, a rear panel, and side panels sealed together to form a tube, and an end closure therefor comprised of dust flaps on said side panels, a cover flap on said rear panel, a tuck-in tab on the free end of said cover flap, and a sealing flap on said front panel adapted to overlie said cover flap, said dust flaps, said cover flap, and said sealing flap being heat-sealed by means of said coating into a unitary end closure and said closure being provided with ply-separation portions and a tear-out portion which, when the tear-out portion is stripped off, frees the cover flap and its tuck-in tab sufficiently that it can be opened and reclosed. Details of the construction and operation of the ply-separation portions and the tear-out portion are included.

18 Claims, 11 Drawing Figures

RECLOSABLE PACKAGE AND CARTON BLANK

BACKGROUND OF THE INVENTION

1. Field of the Invention

The invention relates to a reclosable package and a carton blank used in making the reclosable package. The invention also relates to a process of making the same from carton stock, coated at least on the end closure flaps thereof, with a heat-sealing coating.

2. Prior Art

Various types of reclosable cartons or packages formed of carton stock cut and scored to a plurality of panels and end closure flaps have heretofore been disclosed in which various means for effecting resealing of the package are disclosed. None, however, discloses such a reclosable package in which the carton stock is coated with a heat-sealing coating, in which a unitary end closure is formed by means of the heat-sealing of the various flaps and in which the end closure is provided with ply-separation and tear means which, when separated and torn, frees a cover flap with a tuck-in tab thereon sufficiently that it can be opened and reclosed.

Thus, U.S. Pat. No. 3,297,229, granted Jan. 10, 1967, to G. R. Bluem, discloses a gastight box having dust flaps and a closure flap and a sealing flap which were provided with appropriately located glue strips so that, when the flaps are folded in, a gastight enclosure is obtained. The closure here, however, could be made reclosable only by using a tacky adhesive and does not involve any ply-separation means or tear-out means.

U.S. Pat. No. 2,925,948, granted Feb. 23, 1962, to C. R. Alden, discloses a dispensing container having a reclosable opening which has dust flaps, a cover flap and a sealing flap with a partial tear-out portion, whereby a part of the sealing flap and a part of the closure can be torn out and left hinged at its base to provide a reclosable closure. No ply separation means is involved and no cover having a tuck-in tab is involved.

U.S. Pat. No. 2,889,977, granted June 9, 1959, to K. T. Buttery, discloses a dispensing carton having dust flaps, a cover flap and a sealing flap, in which part of the cover flap is cut away and the portion of the sealing flap overlying the cut-away portion is scored, so that it can be broken away to provide a reclosable cover. The reclosable cover, however, could not be made the full size of the carton end because then there would be no inner closure flap. Moreover, there is no ply-separation means involved.

U.S. Pat. No. 4,317,518, granted Mar. 2, 1982, to Duane R. Mode, discloses a carton in which the end panel is provided with ply-separation means, whereby a pouring spout can be formed in the carton. However, there is no disclosure of a reclosable cover with ply-separation and tear means so that, when separated and torn, a reclosable closure flap having a tuck-in tab is freed.

U.S. Pat. No. 3,438,565, granted Apr. 15, 1969, to T. V. Lugt, et al. discloses a reclosable carton with a tear open spout but there is disclosed no cover flap with a tuck-in tab formed by ply-separation means and tear means.

U.S. Pat. No. 4,201,292, granted May 6, 1980, to Thomas L. Davidson et al., discloses a dispenser carton having an inner closure flap having a tear-out portion and an outer closure flap having a ply-separation portion operative to provide a tuck-in tab which can be inserted into the container after the pull-out portion is removed. There is no disclosure of a closure flap having a tuck-in tab on it which is freed up sufficiently that it can be opened and reclosed when the tear means in cooperation with ply-separation means are actuated.

U.S. Pat. No. 3,934,791, granted Jan. 27, 1976, to Raymond S. Dick, et al., discloses a carton having a complicated end closure designed to facilitate applying adhesive, but involves no ply-separation means or tear means and, moreover, does not rely upon a heat-sealing coating to effect the end closure.

U.S. Pat. No. 4,015,768, granted Apr. 5, 1977, to Noel McLennan, discloses a sealed end carton with a reclosable pouring opening formed by an inner closure flap having a tear-out portion overlying and sealed to the tear-out portion of the inner closure flap such that, when the outer tear-out portion is torn out, the inner tear-out portion is freed and a pouring spout is formed. However, there is no closure flap having a tuck-in tab or ply-separation means and a tear means which cooperate to free the cover flap.

U.S. Pat. No. 3,426,955, granted Feb. 11, 1966, to J. F. Olson, discloses a combination bag and box in which an inner closure flap has a tear-out spout forming portion underlying a portion of an outer flap which can be torn away along one side to provide a hinged closure which can be resealed over the pouring spout which is formed by the inner bag going through the tear-out opening in the inner closure. Here, too, there is no combination of ply-separation means and tear means which frees a cover flap with a tuck-in tab sufficiently that it can be opened and reclosed.

SUMMARY OF THE INVENTION

The invention relates to a carton blank for a reclosable package, having end closure flaps, made of carton stock, coated at least on the end closing flaps thereof, with a heat-sealing coating, which comprises:

a front panel, a rear panel, and side panels adhered together to form a tube, and an end closure therefor comprised of dust flaps on said side panels, a cover flap on said rear panel, a tuck-in tab on the free end of said cover flap, and a sealing flap on said front panel adapted to overlie said cover flap, said dust flaps, said cover flap, and said sealing flap being heat-sealed by means of said coating into a unitary end closure and said closure being provided with ply-separation means and a tear-out means which, when the tear-out means is stripped off, frees the cover flap and its tuck-in tab sufficiently that it can be opened and reclosed.

Advantaeously, the invention comprises such a carton blank in which said tear-out means comprises a substantially trapezoidal portion of said sealing flap, the base of which substantially coincides with the top of said front panel and is substantially as wide as the cover flap thereby leaving small intact portions at each end of said closure which are connected with narrow ply-separation means adjacent the fold line of said dust flaps so that, when said intact portions are ruptured, said ply-separation means permits the cover flap to be pulled up free of said dust flaps and/or in which the cover flap has portions of the ends thereof cut away so that the dust flaps are heat-sealed to the sealing flap and in which the sealing flap has ply-separation means at the ends thereof encompassed by the cut-away portions of the cover flap, said dust flaps having the edges apposed to said cut-away portions cut in a pattern complementary to the adjacent portion of said cut-away portions so that, in the closure, the cut edges of said dust flaps lie substantially side by side with said cut-away portions, at least over the width of said ply-separation means, and being heat-sealed to said ply-separation means but otherwise being unsealded and/or in which said tear-out means has a pull tab which projects beyond the rear panel and is folded down thereon and adhered thereto and in which said rear panel and said cover flap have a ply-separation area underlying said pull-tab and being adhered thereto, so that it is pulled away from the cover flap when the pull-tab is pulled away from the closure.

The invention also includes one or more further features in which said tear-out means comprises a ply-separation strip along the top portion of the front panel, which is substantially in the shape of a trapezoid, the base of which substantially coincides with the base of said trapezoidal portion and the two bases substantially coincide with the top of the front panel, and in which the base of said ply-separation strip comprises a cut-score which is cut from the inside of the carton stock and which extends into said intact portions to facilitate rupture thereof, in which said trapezoidal portion is separable from the sealing flap by double cut scores cut to effect ply separation, and in which the portion of the tear-out means between the double-cut scores is not heat-sealed to the cover flap, in which the cover flap has portions of the ends thereof cut away so that the dust flaps are heat-sealed to the sealing flap and in which the sealing flap has ply-separation means at the ends thereof encompassed by the cut-away portions of the cover flap, said dust flaps having the edges apposed to said cut-away portions cut in a pattern complementary to the adjacent portion of said cut-away portions so that, in the closure, the cut edges of said dust flaps lie substantially side by side with said cut-away portions, at least over the width of said ply-separation means, and being heat-sealed to said ply-separation means but otherwise being unsealed, in which the edge of each dust flap adjacent the cover flap is cut at an angle of about forty-five degrees and in which the corresponding portion of the cut-away portion is cut at a complementary angle, in which the portion of the cover flap underlying the trapezoidal portion of the tear-out means is debossed and coated with a parting substance to prevent heat-sealing in that portion and thus is not heat-sealed, in which said ply-separation area has a substantially rectangular portion in the cover flap and a substantially triangular portion in the rear panel, said cover flap being foldable on said rear panel on a fold line which does not cross said ply-separation area so that, when the cover flap is folded in, the triangular portion breaks free of the rear panel and stays substantially in the plane of the folded-in cover flap until it is folded back into place when the pull tab is folded down and adhered to said rear panel, and in which the side of said ply-separation area apposed to said fold line comprises a knife cut which, while through-cut, is sufficiently tight that the slit left after the ply separation of the ply-separation area is tightly closed. In place of this knife cut, there may be substituted a deep cut score.

The invention also relates to a a reclosable package of the class described having the various features set forth above with regard to said carton blank.

The invention also relates to a process for making a reclosable package of the class described which comprises forming a carton blank as described above, forming a tube therefrom, folding in said dust flaps, folding in said cover flap with the tuck-in tab lying inside of the front panel, folding down the sealing flap to close the end, and heating as required to effect the sealing of the closed end into a unitary closure.

Advantageously, the process of the invention includes further features in which said tear-out means comprises a substantially trapezoidal portion of said sealing flap, the base of which substantially coincides with the top of said front panel and is substantially as wide as the cover flap thereby leaving small intact portions at each end of said closure which are connected with narrow ply-separation means adjacent the fold line of said dust flaps so that, when said intact portions are ruptured, said ply-separation means permits the cover flap to be pulled up free of said dust flaps, in which the cover flap has portions of the ends thereof cut away so that the dust flaps are heat-sealed to the sealing flap and in which the sealing flap has ply-separation means at the ends thereof encompassed by the cut-away portions of the cover flap, said dust flaps having the edges apposed to said cut-away portions cut in a pattern complementary to the adjacent portion of said cut-away portions so that, in the closure, the cut edges of said dust flaps lie substantially side by side with said cut-away portions, at least over the width of said ply-separation means, and being heat-sealed to said ply-separation means but otherwise being unsealed, in which the edge of each dust flap adjacent the cover flap is cut at an angle of about forty-five degrees and in which the corresponding portion of the cut-away portion is cut at a complementary angle.

The process of the invention also may include one or more features in which said tear-out means comprises a ply-separation strip along the top portion of the front panel, which is substantially in the shape of a trapezoid, the base of which substantially coincides with the base of said trapezoidal portion and the two bases substantially coincide with the top of the front panel, and in which the base of said ply-separation strip comprises a cut-score which is cut from the inside of the carton stock and which extends into said intact portions to facilitate rupture thereof, in which said trapezoidal portion is separable from the sealing flap by double cut scores cut to effect ply separation, and in which the portion of the tear-out means between the double-cut scores is not heat-sealed to the cover flap, in which said ply-separation area has a substantially rectangular portion in the cover flap and a substantially triangular portion in the rear panel, said cover flap being foldable on said rear panel on a fold line which does not cross said cut-scored portion so that, on folding the cover flap in, the triangular portion breaks free of the rear panel and stops substantially in the plane of the folded-in cover flap until it is folded back into place when the pull tab is folded down and adhered to said rear panel, and in which the side of said ply-separation area apposed to said fold line comprises a knife cut which, while through-cut, is sufficiently tight that the slit left after the ply separation of the ply-separation area is tightly closed.

The process of the invention may also include one or more further steps which comprises imbossing portions of the dust flaps heat-sealed to said ply-separation means within the confines of said cut-away portions so that the embossed portions project up into said cut-away portions thereby effectuating better contact between the ply-separation portions of the sealing flap and the dust flaps, delineating each imbossed portion by a curvilinear boundry, said cut-away portions being cut on a complementary curve, and covering up said cut-away portions by the end portions of said sealing flap, and debossing the portion of the cover flap underlying the trapezoidal portion of the tear-out means and coating the debossed portion with a parting substance to prevent heat-sealing in that portion.

The process of the invention may also include a further feature in which said tear-out means has a pull-tab which projects beyond the rear panel and said rear panel and sad cover flap have a ply-separation area located to underlie said pull-tab, which further comprises folding down said pull-tab and adhering it to said ply-separation area so that, when the pull-tab is pulled away from the closure, the ply-separation area is pulled away with it.

It is to be understood that the term "ply-separation" is a term commonly used in this art in the same sense that "tear-away" is used in U.S. Pat. No. 4,317,518.

DESCRIPTION OF THE PREFERRED EMBODIMENTS

Figure 1:
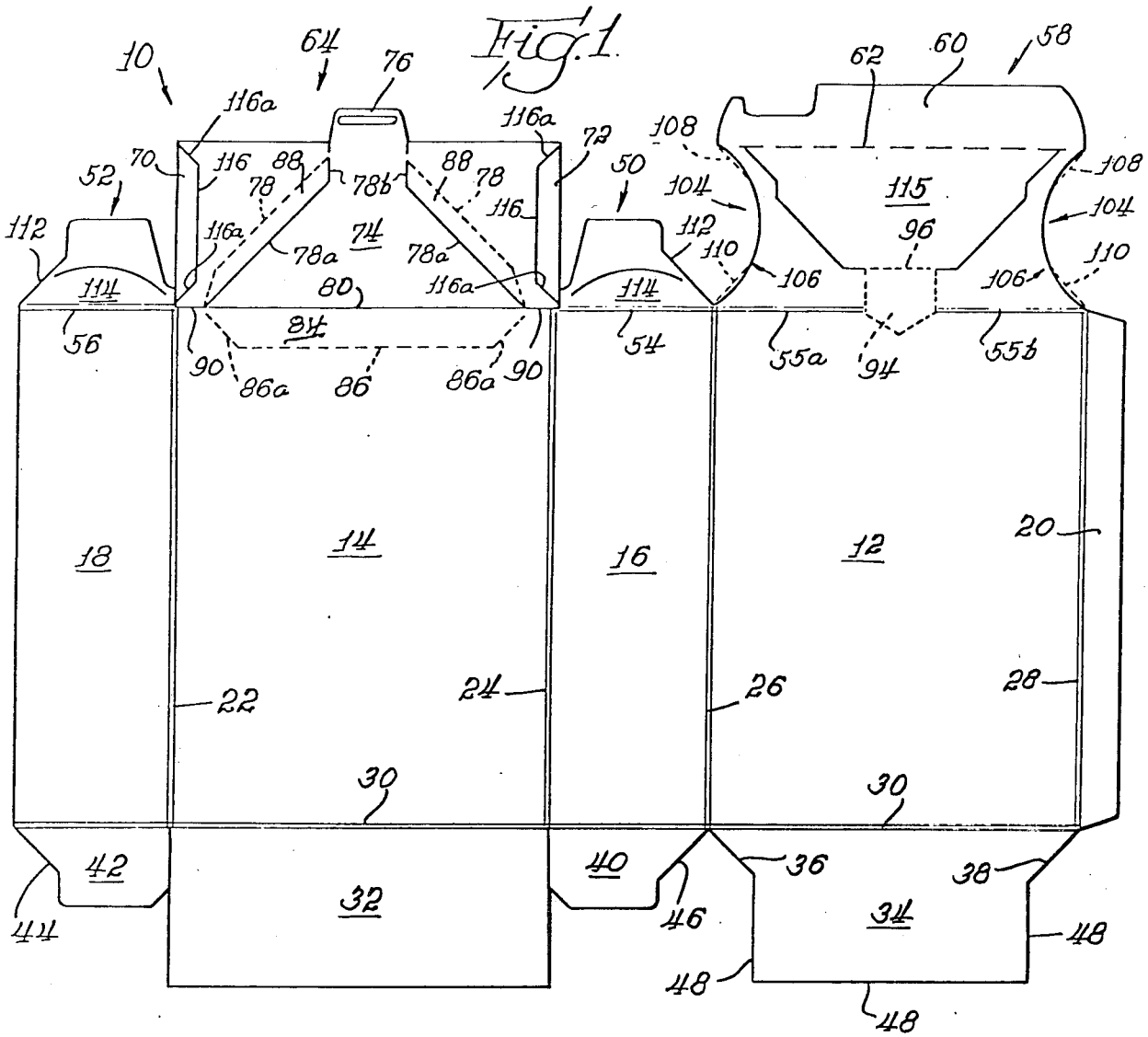
FIG. 1 is a plan view of the inside of a carton blank.
Figure 2:
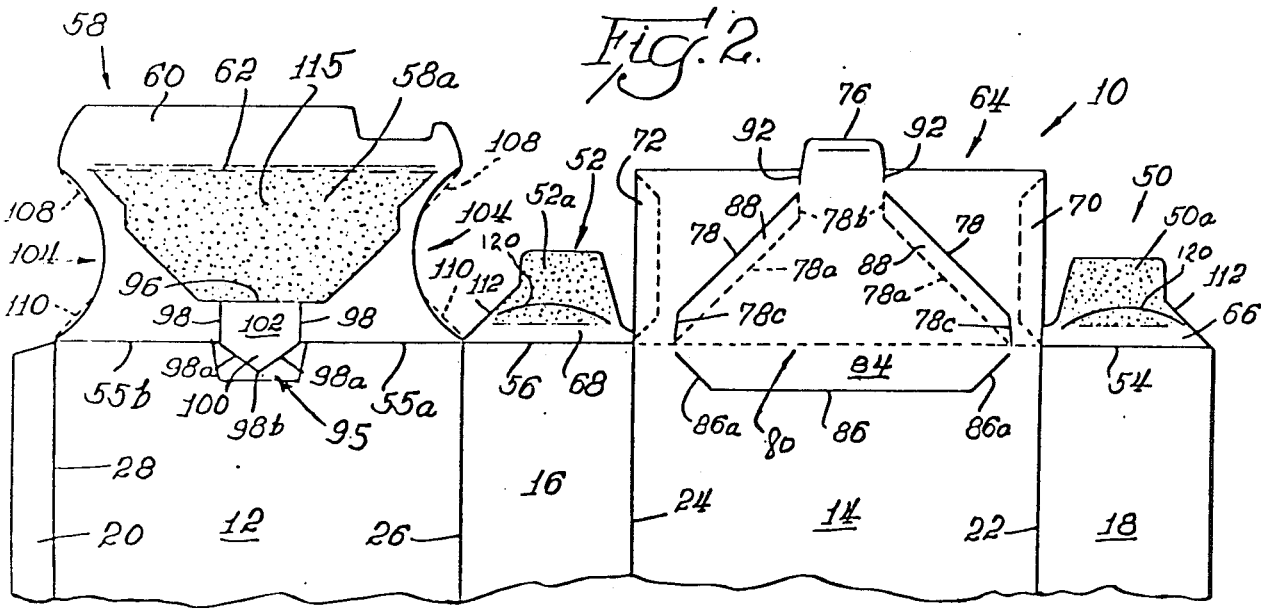
FIG. 2 is a plan view of the outside of the carton blank of FIG. 1.

Referring now to FIGS. 1 and 2, there is shown a carton blank 10 in which FIG. 1 is a view of the inside surface and FIG. 2 is a view of the outside surface.

The carton blank of FIGS. 1 and 2 comprises the rear panel 12, a front panel 14, side panels 16 and 18, and a glue flap 20 articulated by a series of parallel fold lines 22, 24, 26, and 28. Closure forming flaps project from the bottom of the panels and are separated therefrom by fold line 30 which extends all the way across the blank.

The bottom closure flaps may be of any desired design and configuration but, in the modification shown, the outside closure flap 32 is rectangular and has a size and shape conforming to the cross section of the carton tube formed when the glue flap 20 is adhered to side panel 18.

The inner bottom end closure flap 34 has sides cut in at a forty-five degree angle, as shown at 36 and 38. The dust flaps 40 and 42 have their opposed edges cut in, as shown at 44 and 46, complementary to the portions 36 and 38 of the end closure flap 34. The rest of bottom end closure flap 34 may be square cut, as shown at 48. When a carton tube is formed by sealing the glue flap 20 to the side panel 18 and the flaps folded in, the edge 36 of the inner closure flap 34 will abut the edge 46 of the dust flap 40 and the edge 38 of the inner closure flap 34 will abut the edge 44 of the dust flap 42. Thus, the dust flaps 40 and 42 and the inner end closure flap 34 will lie in a common plane so that effective sealing is obtained when the bottom end closure is formed.

The top end closure is formed by two dust flaps 50 and 52 separated from the side panels 16 and 18 respectively by dust flap-side panel fold or score lines 54 and 56; the closure flap 58 having a tuck-in tab 60 articulated thereto by a line of perforations 62; and a sealing flap 64.

For the sake of convenience, the fold lines will sometimes be designated by the flaps and panels that they delineate, for example, "dust flap-side panel fold lines" designates the fold lines 54 and 56 between the dust flaps and the side panels.

The carton stock is coated with a heat-sealable coating, such as polyethylene, or a pattern applied heat-sealable coating, so that juxtaposed surfaces, such as glue flap 20 and the side panel 18, are sealed when a carton tube is formed and the opposed surfaces of 20 and 18 are exposed to the heat sealing section. The bottom end closure is sealed into a unitary closure in a like manner.

In forming the top closure, the dust flaps 50 and 52 and the cover flap 58 are folded in with the tuck-in tab 60 abutting the inside surface of the rear panel 14. The sealing flap 64 is then folded down on top of the cover flap 58. The portions of the cover flap 58 and the dust flaps 50 and 52, shown by stippling, are coated with varnish or like parting compound, so that the stippled portions **58*a* do not become heat-sealed to the sealing panel 64 and the stippled portions 50*a* and 52*a* do not become heat-sealed to the overlying portions of sealing flap 64 and the cover flap 58**.

Along the fold lines 54 and 56, the dust flaps 50 and 52 have narrow strips 66 and 68 which are free of the parting compound and the sealing flap 64 has complementary ply-separation portions 70 and 72 for purposes which will be described.

The sealing flap 64 has a tear-out portion 74 which has a pull-tab 76 projecting beyond its edge. If desired, this pull-tab 76 may be cut out of the tuck-in tab 60 when the carbon blanks 10 are cut from the carton stock.

Figure 8:
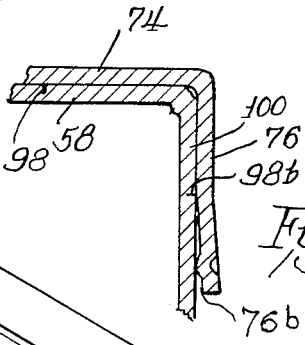
FIG. 8 is a partial view in section on line C—C of FIG. 3.

Near its end, tab 76 is creased to form ridge **76*a* that holds the end of pull tab 76 away from the rear panel 12 and leaves a space 76*b* for a fingernail to lift tab 76 away and up to aid in opening the carton, as best seen in FIG. 8**.

The tear-out portion 74 is essentially in the shape of a trapezoid bounded by the base of the pull-tab 76, the sides 78, and the fold line 80.

The fold line 80 between the panel 14 and the sealing flap 64 is cut-scored on the inside, as shown by the solid line in FIG. 1. The sides of the trapezoid are double-cut scores, the outside one of which, 78, is cut from the outside of the stock, as shown in the solid lines in FIG. 2, and the innermost one is cut from the inside of the stock, as shown in the solid lines in FIG. 1. The cut scores **78*a* extend up vertically at 78*b* to the base of the pull-tab 76 and the cut scores 78 extend downwardly at 78*c* to intersect with the cut scores 78*a* at the fold line 80** at the base of the trapezoid.

A ply-separation tear strip 84 is formed in the top of panel 14. It is formed by the cut score line 86–86*a* which is cut on the outside of the carton stock. The cut line lines 86 and 86*a* form with the fold line 80 a substantially regular trapezoid having the base 80 and sides 86*a* which slope from the top 86 to the juncture of the cut scores 78*c* with the fold line 80. Thus, the fold line 80 and the bases of the two trapezoids 74 and 78 are substantially coincident.

A cut score is to be understood as a score which is formed by cutting into the carton stock a distance sufficiently to cut through a predetermined depth of the paperboard thickness thereof. These may be shallow or deep. Thus, the cut scores 78, 78*a*, 86, and 86*a* are deep cut scores, that is to say, they are cut in to more than about half the thickness of the carton stock. Advantageously, the cut scores 78 and 78*a*, 78*b* and 78*c* are cut in to more than one-half the thickness of the carton stock, so that the bottoms of the cuts from one side reach essentially the same depth as that from the other side, thereby providing effective ply separation in the ply-separation portions 88.

The fold line 80, on the other hand, is a deep cut score which is cut in to substantially more than half the thickness of the carton stock. It extends the full width of panel 14 to provide cut score portions 90 between the sides of the panel 14 and the tear-out portion 74.

The pull-tab 76 has cuts 92 separating it from the rest of the sealing flap 64. These cuts 92 can extend into the sealing flap 64 part way to the juncture of the cut scores 78 and 78*b*, as shown in FIGS. 1 and 2, or they may extend all the way to that juncture. The cuts 92 facilitate starting of the tear-out portion 74.

The cover flap 58 has a tear-out portion 94 in the shape of a pentagon having a base which coincides with the base of the pull-tab 76, sides 98 normal thereto, which, when they reach the inner ends of the fold lines 55*a* and 55*b*, slope inwardly in panel 12 at 98*a* to an apex 98*b*. The base 96 is formed by a knife cut which extends all the way through the carton stock, or by a deep cut score, whereas the sides 98 and 98*a* are cut scores which are cut in from the outside of the carton stock and extend in part way to form deep cut scores. The score lines 55*a* and 55*b* do not extend across the tear out 94, so that the pentagonal tear-out portion 94 does not have a fold line across the base of the triangle formed by the cut scores 98*a*. Constructively, the pentagonal tear-out portion 94 can be conceived as being composed of a triangular portion 100 bounded by the sides 98*a* and a rectangular portion 102 bounded by the sides 96 which portions have a common base.

Advantageously, the cover flap 58 has its end portions cut away, as shown at 104. Otherwise, the dust flaps would have to be sealed to appropriate ply-separation portions in the cover flap and the cover flap to the sealing flap which, though within the scope of the invention, is less desirable because, by virtue of the cut outs 104, the sealing flap 64 is sealed directly to the ply-separation portions 70 and 72 of the dust flaps in a single pass through the heat sealing section.

These cut-away portions may be arcuate, i.e., cut on a curve, as shown in the solid lines 106 but, advantageously, have the initial portions on each end of the curve cut on a forty-five degree angle, as shown in the dotted lines at 108 and 110. The dust flaps 50 and 52 have the sides apposed to the cut outs 104 cut on an angle of forty-five degrees, as shown at 112 so that, when the top end closure is formed, the edges 112 will abut the corresponding portion of the cut away 104, which, advantageously, is straight cut also on an angle of forty-five degrees, as shown by the dotted lines 110. Angles other than forty-five degrees can be used provided the apposed angles are complementary, so that in the assembled closure, the cut sides lie side by side.

Figure 6:
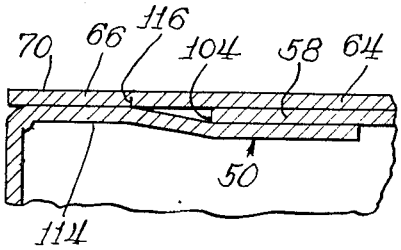
FIG. 6 is a partial view in section taken on line B—B of FIG. 3.
Figure 7:
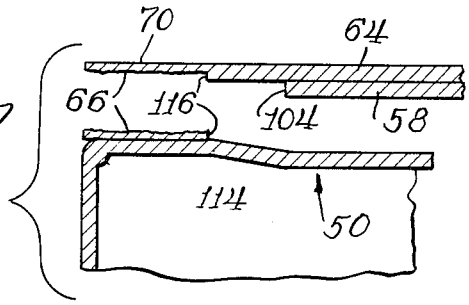
FIG. 7 is a view corresponding to FIG. 6 with the tear-out portion removed and the cover flap broken away from the underlying dust flap.

The dust flaps 50 and 52 have imbossed or raised portions 114, as shown in FIGS. 1, 6, and 7, whereby the portion of the dust flap embossed is raised up through the cut-away portion 104 to effect good contact with the overlying portion of the sealing flap 64, as best seen in FIG. 6.

The imbossed portions 114 are delineated from the rest of the dust flaps 50 and 52 by the curves 120 which, in the first place, conform to the curvature of the cut-outs 104 and, in the second place, do not provide a curve line for the dust flaps 50 and 52 to bend on.

Advantageously, the fold lines 22, 24, 26, 28, 30, 54, 55*a*, 55*b*, and 56 are crease-scored fold lines in which the creasing is effected on the outside of the carton stock, as shown by the solid lines in FIG. 2.

If desired, the pull-tab 76 can be shortened so that its end edge is coincident with the edge of the sealing flap, in which case the triangular tear-out portion in the front panel is eliminated.

The cover flap 58 has a debossed or indented portion 115 which roughly corresponds to the stippled area 58*a* which, in turn, roughly corresponds to the tear-out portion 74 in the sealing flap 64. The combination of the debossed portion 115 and the parting compound 58*a* ensures that in the heat-sealing, the tear-out tab will not become heat-sealed to the portion of the cover flap shown in stippling or in the debossed area.

Figure 9:
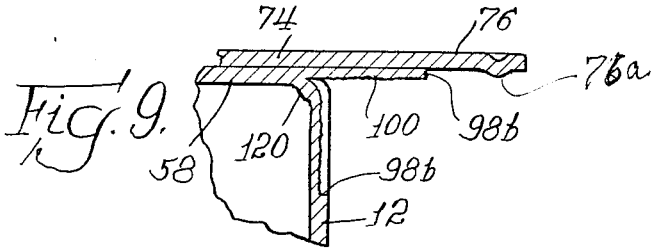
FIG. 9 is a partial view in section corresponding to FIG. 4 with the pull-out tab pulled away from the front panel.

The pentagonal tear-out portion 100, however, is neither debossed nor coated with parting compound, so that the pull-out tab 76 adheres firmly thereto. The Trapezoidal area 95 is also free of parting compound or over varnish so that a portion of tab 76 adheres to panel 12, as shown in FIG. 8. When the cover flap is folded in along fold lines 55*a* and 55*b*, the triangular portion 100 ply-separates from panel 12 and thus lies flat against the pull-tab 76 when the sealing flap 64 is folded in. This is best seen in FIG. 9. At the same time, however, the plow folds the pull-tab 76 down against the rear panel 12, as best seen in FIG. 8. The ply-separated triangular portion is thus folded back into its initial position. At the same time, the pull-tab 76, which has an area greater than that of the triangular portion, as best seen in FIG. 10, is heat-sealed against panel 12.

The ply-separation portions 70 and 72 are formed by deep cut scores 116 and 116*a* which, in the top end closure, are sealed to the narrow strips 66 and 68 of the dust flaps 50 and 52 between the fold lines 54 and 56 and the stippled areas 50*a* and 52*a*. The areas 118 on either side of the pull-tab 76 and between the cut scores 78*a* and the end edges of the sealing flap are sealed to the cover flap 58 and overlie the cut outs 104.

Figure 10:
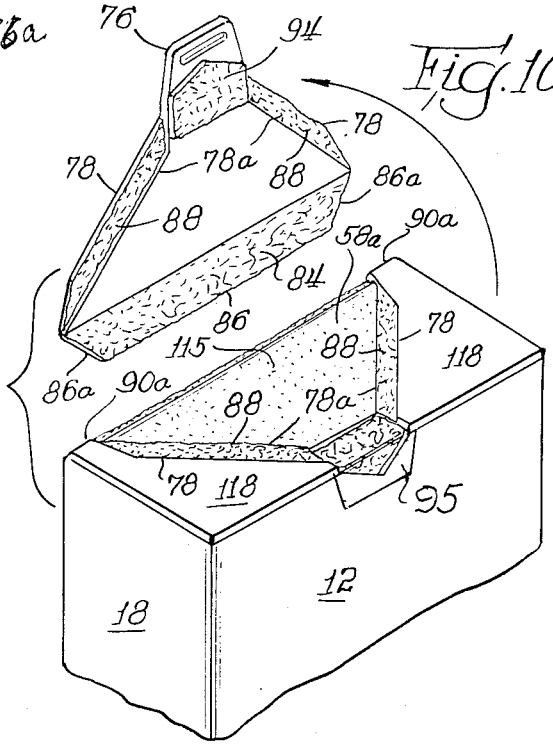
FIG. 10 is an isometric view showing the tear-out portion torn out.
Figure 3:
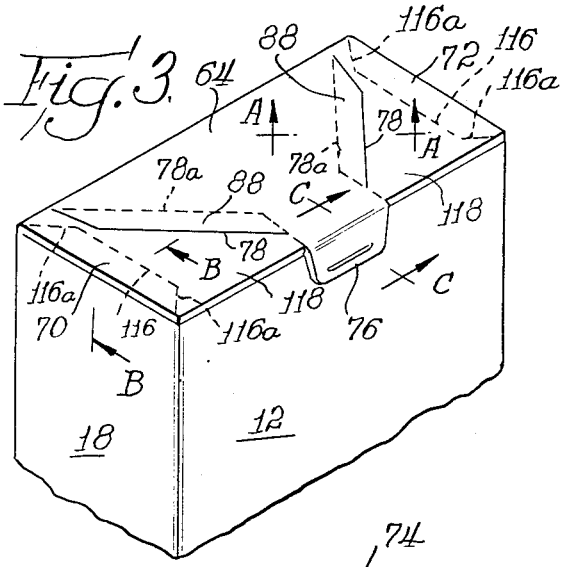
FIG. 3 is an isometric view of a package formed from the carton blank of FIGS. 1 and 2.
Figure 4:
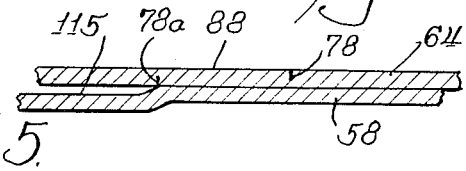
FIG. 4 is a partial view in section taken on line A—A of FIG. 3.
Figure 5:
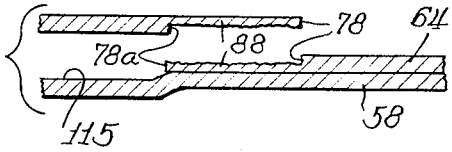
FIG. 5 is a view corresponding to FIG. 4 with the tear-out portion torn away.
Figure 11:
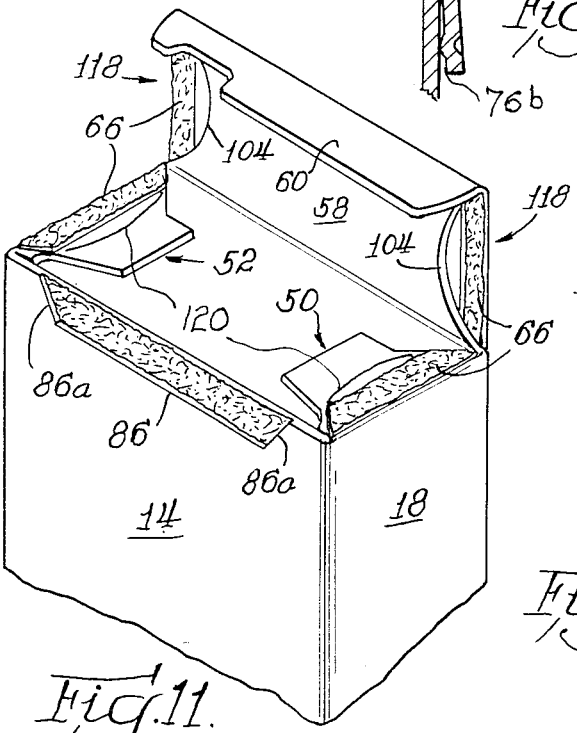
FIG. 11 is an isometric view showing the cover flap broken away and in open position.

When the pull-tab 76 is broken loose, to the position shown in FIG. 9, continued pulling will cause ply-separation in the portions 88, as best seen in FIGS. 4 and 5 and continued pulling of the pull tab will cause complete separation of the tear-out portion 74, as best seen in FIG. 10. This leaves the cover flap fastened to the front panel only by the narrow intact portions 90*a*, which have the deep cut scores 90 on the inner surface. This makes the intact portions 90*a* easily rupturable. When ruptured, the ply-separation portions 70 and 72 are brought into play, as shown in FIGS. 6, 7, and 8, and the cover 58, including the overlying portions 118 can be broken free at 90*a* to provide a reclosable cover.

There is thus provided a reclosable carton which has a completely sealed unitary end closure which is provided with ply-separation means and a tear-out means which, when the tear-out means is stripped off, the cover flap and its tuck-in tab are sufficiently freed that it can be opened and reclosed.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. A carton blank for a reclosable carton, having end closure flaps, made from carton stock coated, at least on the end closing flaps thereof, with a heat-sealing coating, which comprises:

a front panel, a rear panel, and side panels adapted to be sealed together to form a carton tube, and end closure flaps therefor comprised of dust flaps, a cover flap and a sealing flap which flaps can be folded in, in the order named, to form an end closure; p1 said dust flaps having narrow, heat-sealable areas adjacent and along the dust flap-side panel fold lines from one end to the other end thereof;

said cover flap having portions along the end edges thereof cut away complementary with the heat-sealable areas of said dust flaps and a heat-sealable area along and adjacent the cover flap-rear panel fold line from one end of said cover flap to the other end thereof and which, in the erected carton, forms with said dust-flap heat-sealable areas, a continuous, planar, generally U-shaped sealing zone along and adjacent to the cover flap-rear panel fold line and the dust flap-side panel fold lines;

said continuous, planar, generally U-shaped sealing zone, in the end closure in the erected carton, lying in juxtaposition with a correspondingly planar, generally U-shaped sealing zone of said sealing flap with the juxtaposed portions of said cover flap and said sealing flap lying within said generally U-shaped sealing zones being unsealable and said end closure flaps being thus heat-sealable by means of said juxtaposed, continuous, planar, generally U-shaped sealing zones into a unitary end closure;

said sealing flap having a portion separable therefrom by ply-separation means coincident with the inner edges of said generally U-shaped sealing zones whereby, when said end closure is made, the unsealed portion of said sealing flap can be stripped away from the unsealed portion of said cover flap, and wherein said cover flap has tear means which, when said end closure is made, facilitates opening thereof and provides a cover that can be opened and reclosed;

said end closure being formed into a carton without the addition of adhesive or other material; and said cover flap being free of openings therein or opening-forming tear-outs therein.

2. A carton blank of claim 1 in which the separable portion of said sealing flap comprises a substantially trapezoidal portion, the base of which substantially coincides with the sealing flap-front panel fold line and is substantially as wide as the sealing flap but is inset enough to leave small intact portions, one at each end of the sealing flap, which are connected with said front panel by cut-score lines of weakness and form said tear means; in which said sealing flap has narrow ply-separation strips along the side edges thereof which extend from adjacent said intact portions to adjacent the end edge of said sealing flap and, in the erected carton, overlie the narrow, heat-sealable areas of said dust flaps; in which said narrow, heat-sealable areas, and the cut-away portions of said cover flap have complementary end edges which line up in the end closure in the erected carton in substantial abutment; and in which, in the end closure in the erected carton, said narrow ply-separation strips are heat sealed to the narrow, heat-sealable areas of said dust flaps.

3. A carton blank of claim 2 in which said front panel comprises a substantially trapezoidal ply-separation tear strip, the base of which substantially coincides with the base of the trapezoidal portion of said sealing flap and the two bases coincide with the sealing flap front panel fold line, and in which said bases comprise a cut-score which is cut from the inside of the carton stock and which extends into said intact portions to provide said lines of weakness.

4. A carton blank of claim 2 in which the portion of the cover flap adapted to underlie the trapezoidal portion of the sealing flap is debossed and coated with a parting substance to prevent heat-sealing in that portion.

5. A carton blank of claim 1 in which said dust flaps have the edges opposed to said cut-away portions cut in a pattern complementary to the adjacent edges of said cut-away portions.

6. A carton blank of claim 5 in which the edge side of each dust flap that the not adjacent the sealing flap is cut at an angle of about forty-five degrees and in which the corresponding portion of the cut-away portion is cut at a complementary angle.

7. A carton blank of claim 1 in which the heat sealable portions of said dust flaps are embossed in a pattern complementary with but smaller than said cut-away portions so that, when the cover flap laps the dust flaps in the end closure, the embossed portions project up into said cut-away portions thereby effectuating better contact between the sealing flap and the dust flaps and in which said small portions of the dust flaps, as well as the portions covered by the same, are coated with a non-sealing coating.

8. A carton blank of claim 1 in which the portion separable from said sealing flap by ply-separation means has a pull tab which projects beyond the end edge of said sealing flap; in which said rear panel and said cover flap have a ply-separation area complementary with said pull tab and which is adapted to be adhered thereto in the end closure; and in which, in the erected carton, said ply-separation area, including the portion thereof which extends across the cover flap-rear panel into the rear panel, underlies said pull-tab and is adhered thereto and said separable portion is adapted to be pulled away from said cover flap when the pull-tab is pulled away from the said closure.

9. A reclosable package having end closure flaps made of carton stock coated, at least on the end closure flaps thereof, with a heat-sealing coating, which comprises:

a carton tube having a front panel, a rear panel, and side panels, and end closure flaps therefor articulated to said panels by fold lines and comprised of dust flaps, a cover flap overlying said dust flaps and having portions of the side edges thereof cut away which expose narrow sealing areas on said dust flaps along the fold lines thereof and a sealing area along the fold line of said cover flap, and a sealing flap which overlies said cover flap and the sealing areas of said flaps to form the end closure of the package, said sealing areas forming a continuous, generally U-shaped sealing zone, the sides of which comprise the narrow sealing areas of said dust flaps and the bight of which comprises the sealing area along the fold line of said cover flap and said sealing flap being heat-sealed to said generally U-shaped sealing zone by means of said coating into a unitary end closure and not otherwise sealed to said cover flap or said dust flaps, and said end closure being provided with ply-separation means and tear means which facilitate opening thereof and provide a cover that can be opened and reclosed, and said cover flap being free of openings or opening-forming tear-outs therein.

10. A package of claim 9 in which said sealing flap comprises a substantially trapezoidal, unsealed tear-away portion, the base of which substantially coincides with the top of said front panel and is substantially as wide as the cover flap but is inset enough to leave small intact portions, one at each end thereof, which are connected with said front panel by cut-score lines of weakness, and in which said sealing flap has narrow ply-separation strips along the side edges of said sealing flap which extend from adjacent said intact portions to adjacent the end edge of said sealing flap, the portions of said sealing flap between said ply-separation strips and the trapezoidal portion of said sealing flap being sealed to said cover flap and forming part of a composite cover flap when said tear-away portion is torn away so that, when said intact portions are ruptured, said ply-separation strips permit the composite cover flap to be pulled out free of said dust flaps.

11. A package of claim 10 in which said tear-away portion comprises a ply-separation tear strip coincides with the base of the trapezoidal portion of said sealing flap and the two bases coincide with the fold line between the front panel and the sealing flap, and in which said bases comprise a cut-score which is cut from the inside of the carton stock and which extends into said intact portions to provide said lines of weakness.

12. A package of claim 10 in which the portion of the cover flap underlying the trapezoidal portion of is debossed and coated with a parting substance to prevent heat-sealing in that portion and thus is not heat-sealed.

13. A package of claim 9, in which the sealing flap has ply-separation strips at the ends thereof encompassed by the cut-away portions of the cover flap, said dust flaps being heat-sealed to said ply-separation means but otherwise being unsealed.

14. A package of claim 13 in which the edge of each dust flap adjacent the cover flap is cut at an angle of about forty-five degrees and in which the corresponding portion of the cut-away portion is cut at a complementary angle.

15. A package of claim 9 in which said unsealed portion of said sealing flap has a pull tab which projects beyond the rear panel and is folded down thereon and adhered thereto and in which said rear panel and said cover flap have a ply-separation area underlying said pull-tab and being adhered thereto, so that it is pulled away from the cover flap when the pull-tab is pulled away from the closure.

16. In a carton blank made of carton stock coated with a heat sealing coating and having front and rear main panels, side panels, and a set of end closure flaps which comprises dust flaps, a cover flap, and a sealing flap: the improvement in which;

said dust flaps have dust flap-side panel fold lines and are debossed about the thickness of the carton stock leaving raised portions along said fold lines;

said cover flap has its ends cut away complementarily to said raised portions, whereby, in the erected carton, the raised portions project into the cut-away portions and present a surface adapted to be sealed to the under surface of said sealing flap when it is folded in onto the cover flap;

the unembossed portions of said dust flaps are coated with a non-sealing coating;

the cover flap is coated with a non-sealing coating, except for a continuous generally, U-shaped, sealing portion extending, in the erected carton, from the raised portion of one dust flap to the raised portion of the other dust flap to provide a continuous, uninterrupted seal between the outer edges of the sealing flap and the underlying flap portions.

17. A reclosable package having end closure flaps, made from carton stock coated, at least on the end closing flaps thereof, with a heat-sealing coating, which comprises:

a front panel, a rear panel, and side panels sealed together to form a carton tube, and end closure flaps therefor comprised of dust flaps, a cover flap, and a sealing flap which flaps are folded in, in the order named, to form an end closure;

said dust flaps having narrow, heat-sealed areas adjacent and along the dust flap-side panel fold lines from one end to the other end thereof;

said cover flap having portions along the end edges thereof cut away complementary with the heat-sealed areas of said dust flaps and a heat-sealed area along and adjacent the cover flap-rear panel fold line from one end of said cover flap to the other end thereof and which forms with said dust-flap heat-sealed areas, a continuous, planar, generally U-shaped, zone along and adjacent to the cover flap-rear panel fold line and the dust flap-side panel fold lines;

said continuous, planar, generally U-shaped zone lying in juxtaposition with a correspondingly planar, generally U-shaped zone of said sealing flap thereby forming a correspondingly planar, generally U-shaped sealed zone with the juxtaposed portions of said cover flap and said sealing flap lying within said generally U-shaped sealed zones being unsealed and said end closure flaps being thus heat-sealed into a unitary end closure;

said sealing flap having an unsealed portion separable therefrom by ply-separation means coincident with the inner edges of said generally U-shaped sealing zones whereby the unsealed portion of said sealing flap can be stripped away from the unsealed portion of said cover flap and wherein said cover flap has tear means which, after the cover is exposed, facilitates opening thereof and provides a cover that can be opened and reclosed;

said end closure being formed without the addition of adhesive or other material; and said cover flap being free of openings therein or opening-forming tear-outs therein.

18. A carton blank for a reclosable package having end closure flaps made of carton stock coated, at least on the end closure flaps thereof, with a heat-sealing coating, which comprises:

a front panel, a rear panel, and side panels adapted to be formed into a tube, and end closure flaps therefor articulated to said panels by fold lines comprised of dust flaps, a cover flap adapted to overlie said dust flaps and having portions of the side edges thereof cut away which expose narrow sealing areas on said dust flaps along the fold lines thereof and a sealing area along the fold line of said cover flap, and a sealing flap which, in the package formed from said carton blank, overlies said cover flap and the sealing areas of said flaps to form the end closure of the package, said sealing areas forming a continuous, generally U-shaped sealing zone, the sides of which comprise the narrow sealing areas of said dust flaps and the bight of which comprises the sealing area along the fold line of said cover flap and said sealing flap being heat-sealable to said generally U-shaped sealing zone by means of said heat-sealable coating into a unitary end closure and being protected from being sealed to said cover flap or said dust flaps, and said end closure flaps being provided with ply-separation means and tear means which, when said end closure is made, facilitate opening thereof to provide a cover that can be opened and reclosed, and said cover flap being free of openings or opening-forming tear-outs therein.

* * * * *

UNITED STATES PATENT AND TRADEMARK OFFICE

CERTIFICATE OF CORRECTION

PATENT NO. : 4,613,046

DATED : September 23, 1986

INVENTOR(S) : Morris W. Kuchenbecker

It is certified that error appears in the above-identified patent and that said Letters Patent is hereby corrected as shown below:

Title page, [73] Assignee:; after "Corporation" insert -- of Virginia --

Title page, [56] References Cited, U.S. PATENT DOCUMENTS, on the right side of patent, second line; before "Lugt et al." insert -- Vander --

Title page, [56] References Cited, U.S. PATENT DOCUMENTS, on the right side of patent, after the last U.S. Patent Document entry insert the following:

| | | | |
|---|---|---|---|
| -- | 2,889,977 | 6/59 | K. T. Buttery |
| | 2,925,948 | 2/62 | C. R. Alden |
| | 3,297,229 | 1/67 | G. R. Bluem |
| | 3,934,791 | 1/76 | Raymond S. Dick, et al. |
| | 4,015,768 | 4/77 | Noel McLennan |
| | 4,201,292 | 5/80 | Thomas L. Davidson, et al. |
| | 4,317,518 | 3/82 | Duane R. Mode -- |

Col. 1, line 59; "V." should read -- Vander --
Col. 2, line 52; "Advantaeously" should read -- Advantageously --
Col. 3, line 6; "unsealded" should read -- unsealed --
Col. 3, line 62; delete "a" (second occurrence)
Col. 4, line 62; "imbossing" should read -- embossing --
Col. 4, line 68; "imbossed" should read -- embossed --
Col. 5, line 11; "sad" should read -- said --
Col. 7, line 3; delete "line "
Col. 8, line 7; "imbossed" should read -- embossed --
Col. 8, line 13; "imbossed" should read -- embossed --
Col. 8, line 37; "Trapezoidal" should read -- trapezoidal --
Col. 9, line 26; delete "pl" and start a new paragraph with "said"

UNITED STATES PATENT AND TRADEMARK OFFICE

CERTIFICATE OF CORRECTION

PATENT NO. : 4,613,046

DATED : September 23, 1986

INVENTOR(S) : Morris W. Kuchenbecker

It is certified that error appears in the above-identified patent and that said Letters Patent is hereby corrected as shown below:

Col. 10, line 33; "edge side" should read -- side edge --

Col. 10, line 34; delete "that the"
Col. 11, line 23; after "unsealed" insert a comma -- , --

Col. 11, line 49; after "of" insert -- said sealing flap --

Col. 2, line 21; "1966" should read -- 1969 --

Signed and Sealed this

Third Day of February, 1987

*Attest:*

*Attesting Officer*

DONALD J. QUIGG

*Commissioner of Patents and Trademarks*